US007800560B2

(12) United States Patent
Ichikura

(10) Patent No.: US 7,800,560 B2
(45) Date of Patent: Sep. 21, 2010

(54) DRIVER FOR DISPLAY PANEL

(75) Inventor: Hiroyuki Ichikura, Tokyo (JP)

(73) Assignee: Oki Semiconductor Co., Ltd., Tokyo (JP)

( * ) Notice: Subject to any disclaimer, the term of this patent is extended or adjusted under 35 U.S.C. 154(b) by 792 days.

(21) Appl. No.: 11/624,650

(22) Filed: Jan. 18, 2007

(65) Prior Publication Data

US 2007/0188420 A1 Aug. 16, 2007

(30) Foreign Application Priority Data

Feb. 16, 2006 (JP) ..... 2006-039915

(51) Int. Cl.
*G09G 3/30* (2006.01)

(52) U.S. Cl. ..... 345/77; 345/83

(58) Field of Classification Search ..... 345/76–77, 345/82–84

See application file for complete search history.

(56) References Cited

U.S. PATENT DOCUMENTS 5,973,456 A * 10/1999 Osada et al. ..... 315/169.1
7,034,782 B2 * 4/2006 Miyakawa et al. ..... 345/76
2005/0156830 A1 * 7/2005 Tobita ..... 345/76
2006/0022911 A1 * 2/2006 Satoh et al. ..... 345/76
2006/0170631 A1 * 8/2006 Togashi et al. ..... 345/82

FOREIGN PATENT DOCUMENTS

JP 2004-302025 A 10/2004

* cited by examiner

*Primary Examiner*—Chanh Nguyen
*Assistant Examiner*—Kwang-Su Yang
(74) *Attorney, Agent, or Firm*—Volentine & Whitt, PLLC

(57) ABSTRACT

It is an object of the present invention to provide a driver for a display panel in which a plurality of light-emitting elements are arranged in a matrix, which prevents false emission and/or destruction of the light-emitting elements from being caused when reset control is performed when scanning row lines included in the display panel. A cathode driver comprises a plurality of groups composed of a timing circuit and transistors that correspond to a plurality of cathode lines, respectively. Each of the timing circuits controls the timing for switching on the transistors, so that the potentials of all the cathode lines excluding the cathode line that is the target to be scanned are slowly changed from the ground potential to the power supply potential after the reset period elapses.

4 Claims, 9 Drawing Sheets

*PRIOR ART*

PRIOR ART

PRIOR ART

DRIVER FOR DISPLAY PANEL

CROSS-REFERENCE TO RELATED APPLICATIONS

This application claims priority to Japanese Patent Application No. 2006-033915. The entire disclosure of Japanese Patent Application No. 2006-033915 are hereby incorporated herein by reference.

BACKGROUND OF THE INVENTION

1. Field of the Invention

The present invention relates to a scan line drive technology for a display panel in which light-emitting elements emitting light by means of current drive performed by organic light-emitting diodes (OLEDs), organic electroluminescences (OELs), and the like that are arranged in a matrix.

2. Background Information

A display unit in which OLED elements functioning as self luminous elements are arranged in a matrix has been known. The display unit in which OLED elements are used is a low power consumption unit, and requires no lighting component such as a backlight. In addition, the response speed of such a display unit is very fast. Therefore, it shows much promise as a future display unit.

A conventional driver for a display unit in which OLED elements are used will be hereinafter explained with reference to FIGS. 1 and 2. Note that the conventional driver shown in FIG. 2 is disclosed as prior art in Japan Patent Application Publication JP-A-2004-302025.

FIG. 1 is a diagram showing an equivalent circuit of an OLED element. FIG. 2 is a diagram showing a configuration of a display unit in which OLED elements are used and conventional drivers are included.

As shown in FIG. 1, an OLED element is expressed by an equivalent circuit comprised of a diode component E and a parasitic capacitance component Cp that is connected to the diode component E in parallel. In other words, the OLED element is a capacitive light emitting element.

In a display unit 40 shown in FIG. 2, m×n number of OELD elements E_11 to E_mn arranged in a matrix are coupled to intersections between m number of cathode lines (i.e., row lines) and n number of anode lines (i.e., column lines).

A driver (cathode driver 21) in the cathode side of the OLED elements includes m number of switching elements SW_10 to SW_m0 that are connected to m number of cathode lines H_1 to H_m, respectively. Each of the switching elements SW_10 to SW_m0 operates in response to a control signal output from a light-emitting control circuit (CONT) 11, and connects each of the cathode lines H_1 to H_m to a power supply potential $V_{DD}$ (high-level or simply H-level) or a ground potential (low-level or simply H-level). Reverse bias voltage is set to be applied to an OLED element connected to the cathode line that is connected to the H-level.

A driver (anode driver 30) in the anode side of the OLED elements includes n number of switching elements SW_01 to SW_0n that are connected to n number of anode lines V_1 to V_n, respectively. Each of the switching elements SW_01 to SW_0n operates in response to a control signal from the light-emitting control circuit 11, and connects each of the anode lines V_1 to V_n to n number of constant current sources CS_1 to CS_n, respectively, or the L-level.

For example, an OLED element E_21 emits light if a constant current source CS_1 is connected to a switching element SW_01 while a cathode line H_2 is scanned. If this is performed, forward bias is applied to a diode component of the OLED element E_21. Accordingly, the OLED element E_21 emits light.

In the conventional driver shown in FIG. 2, reset control is performed when each of the columns in the cathode side of the OLED elements arranged in a matrix is sequentially scanned. In other words, a reset period is set to be inserted in the period during which cathode lines are sequentially scanned in the reset control. In this reset period, all the cathode lines and anode lines are once set to be a reset potential (ground potential in FIG. 2).

FIG. 3 is a timing chart showing an operation of a conventional driver by which reset control is performed. FIG. 3 is comprised of two sub-charts (a) and (b). The sub-chart (a) shows signal waveforms of anode lines, and the sub-chart (b) shows signal waveforms of cathode lines.

As shown in the sub-chart (b) of FIG. 3, in the reset control, reset periods RS are set to be inserted between a period T1 during which a cathode line H_1 is scanned and a period T2 during which a cathode line H_2 is scanned, and between the period T2 and a period T3 during which a cathode line H_3 is scanned. For example, the cathode line H_1 is connected to the L-level during the period T1, and all the OLED elements connected to the cathode line H_1 emit light in response to current from the constant current sources CS_1 to CS_n. All the cathode lines excluding the cathode line H_1 are in the H-level during the period T1. Therefore, parasitic capacitance components in the OLED elements connected to the cathode lines H_2 and H_3, for instance, are in a charged state while the side thereof connected to the cathode line functions as a positive electrode. Based on this, electric charges built up in the parasitic capacitance components are discharged by once setting all the cathode lines and anode lines to be the ground voltage during the reset period RS immediately after the period T1. Because of this discharge, current instantaneously flows into the parasitic capacitance components of the OLED elements that should emit light from the cathode lines H_1, H_3, . . . H_m excluding the cathode line H_2 during the period T2. Thus, the parasitic capacitance components of the OLED elements that should emit light are charged.

However, false emission and/or destruction of the OLED element(s) may be caused in the conventional driver by which reset control is performed. The following is an explanation thereof.

As shown in FIG. 3, all the cathode lines in the conventional driver are in the L-level during the reset periods RS. At time t1, time t2, and time t3, when scanning of any of the cathode lines starts, the potentials of all the cathode lines excluding the target to be scanned are set to be changed from the L-level to the H-level.

For example, at the time t1, potential of the cathode line H_1 that is the target to be scanned during the period T1 is set to be the L-level, and potentials of the cathode lines H_2 and H_3 that are not the targets to be scanned during the period T1 are set to be changed from the L-level to the H-level. At this time, potentials of the cathode lines H_2 and H_3 extremely change. Therefore, parasitic capacitance components of the OLED elements connected to the cathode lines H_2 and H_3 instantaneously switch on. This results from the fact that impedance of the parasitic capacitance component is transiently reduced when extreme potential change occurs.

If the parasitic capacitance components of the OLED elements connected to the cathode lines H_2 and H_3 instantaneously switch on, the potentials of anode lines that should not originally be high will leap through the parasitic capacitance components (see the time t1 shown in the sub-chart (a) of FIG. 3). Accordingly, the OLED element coupled to the anode lines will falsely emit light. In addition, unintended high voltage will be applied to the anode lines due to the instantaneous switch-on of the parasitic capacitance components. Therefore, there is a possibility that the OLED elements will be destroyed. As shown in FIG. 3, the parasitic capacitance components of the OLED elements instantaneously switch on not only at the time t1, but also at the starting times of scanning the cathode lines excluding the time T1 (i.e., t2, t3 . . . ).

A display unit with approximately 4000 displayable colors was developed several years ago, and display of the colors is realized by 4-bit (i.e., 16 gradations) emission of each of the RGB light-emitting elements. Recently, the number of displayable colors has been remarkably increasing in display units in which OLED elements are used. For example, a display unit that can display 65000 colors or 260000 colors has been developed. In other words, a display unit in which each of the RGB light-emitting elements emits 5-bit (i.e., 32 gradations) or greater has been developed. The color gradation is determined by the pulse width modulation (PWM) period of current that follows through OLED elements. When the above described false emission occurs, false colors are generated by gradation changes in accordance with this false emission. In particular, as the number of bits of each of the RGB light-emitting elements in a display unit increases from five to six, the impact of the false emission on the false colors has been measurable.

In view of the above, it will be apparent to those skilled in the art from this disclosure that there exists a need for an improved driver for a display panel in which a plurality of light-emitting elements are arranged in a matrix, the driver preventing false emission and/or destruction of the light-emitting elements from being caused when the above described reset control is performed during the scanning of row lines included in the display panel. It is also apparent to those skilled in the art from this disclosure that there exists a need for a method of manufacturing this improved driver. This invention addresses these needs in the art as well as other needs, which will become apparent to those skilled in the art from this disclosure.

SUMMARY OF THE INVENTION

A first aspect of the present invention is to provide a driver for a display panel that comprises a scan unit, a reset unit, and a potential control unit.

The scan unit sequentially scans a plurality of row lines with respect to the display panel in which a plurality of light-emitting elements are arranged in a matrix at intersections between the plurality of row lines and a plurality of column lines, by connecting a first row line that is the target to be scanned to a first reference potential, and by connecting all the other row lines excluding the first row line that is the target to be scanned to a second reference potential that is higher than the first reference potential during a single scan period.

The reset unit sets a reset period between two scan periods for adjacent row lines and connects the plurality of row lines to the first reference potential during the reset period.

The potential control unit controls the potentials of the other row lines excluding the first row line from the first reference potential to the second reference potential at a predetermined rate of potential change to time or less after the reset period elapses.

According to the present invention, when the above described reset control is performed in performing the scanning of row lines with respect to a display panel in which the plurality of light-emitting elements are arranged in a matrix, the potentials of the other row lines excluding the first row line that is the target to be scanned slowly change from the first reference potential to the second reference potential after the reset period elapses. Because of this, the parasitic capacitance components of the light-emitting elements connected to the row lines do not switch on. Accordingly, the false emission and/or destruction of light-emitting elements will not be caused.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

First Embodiment

A driver in accordance with the first embodiment of the present invention will be hereinafter explained in detail with reference to FIGS. 4 to 7.

Figure 1:
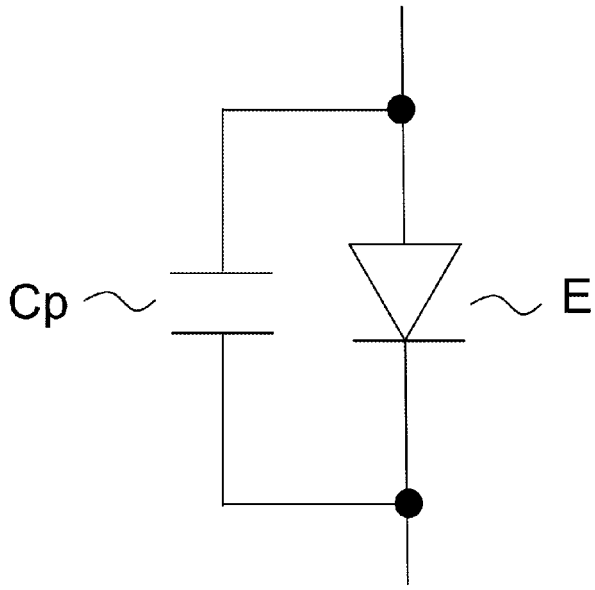
FIG. 1 is a diagram showing an equivalent circuit of an OLED element.
Figure 2:
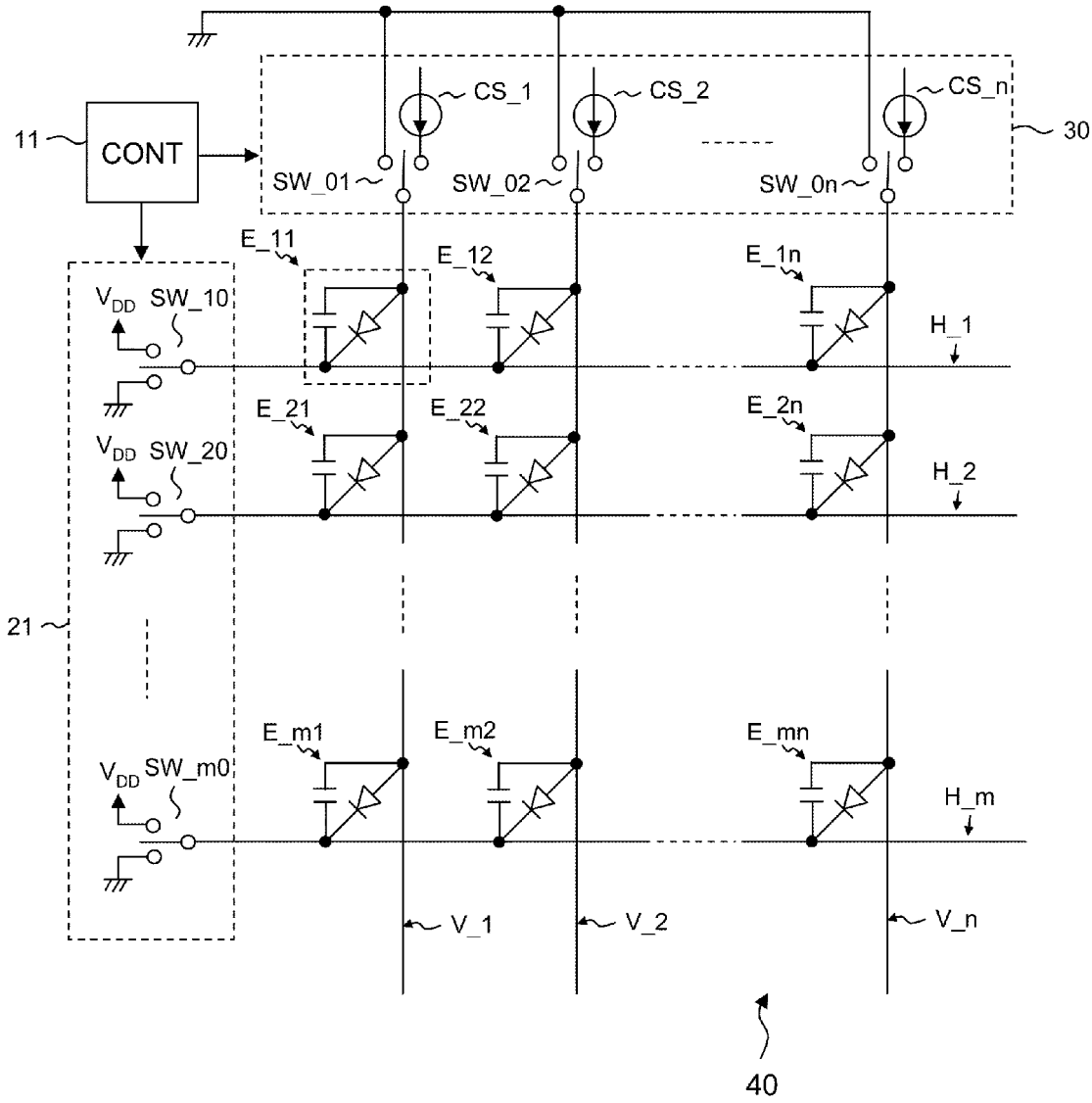
FIG. 2 is a diagram showing the configuration of a display unit in which OLED elements are used and conventional drivers are included.
Figure 3:
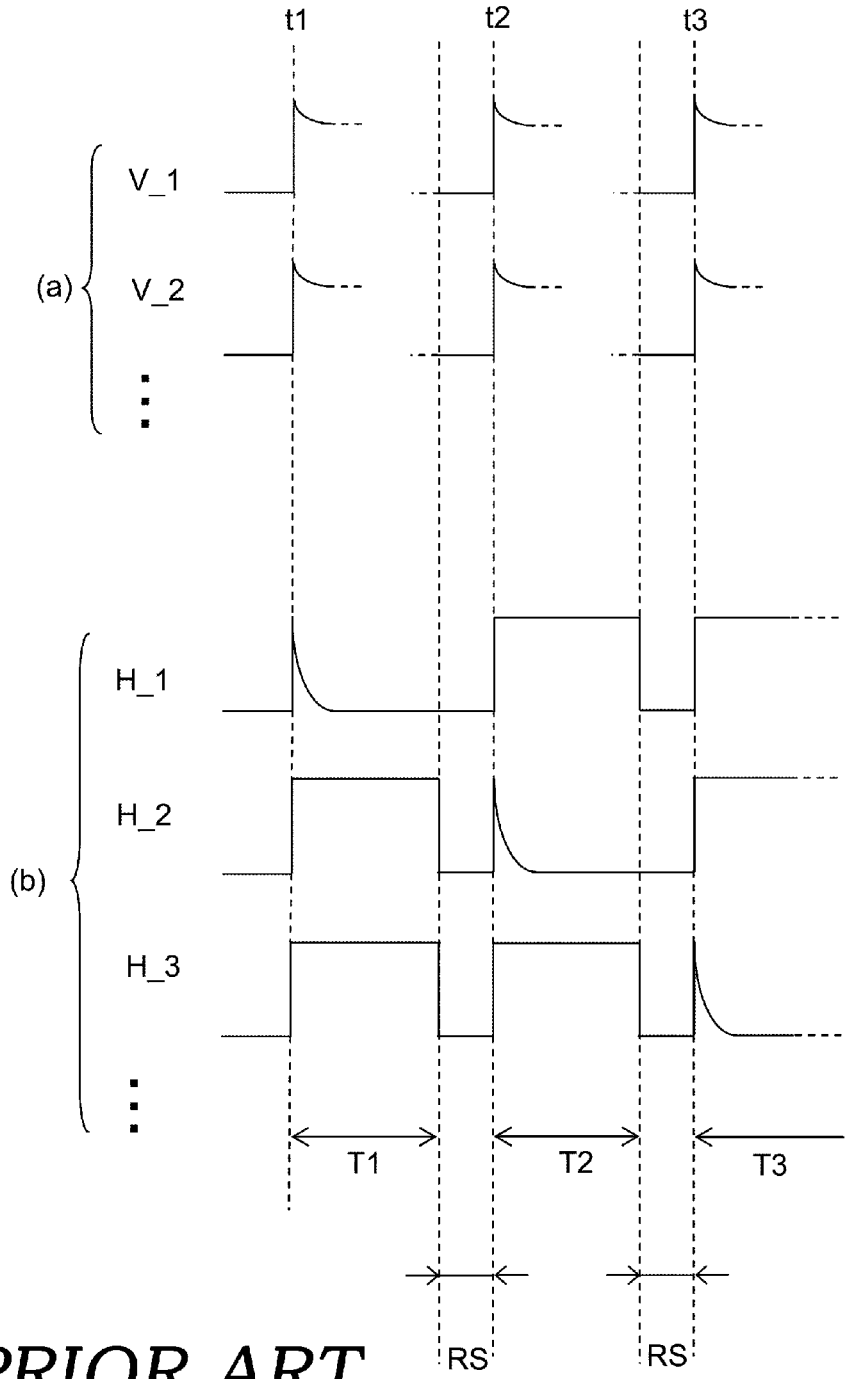
FIG. 3 is a timing chart showing the operation of a conventional driver by which a reset control is performed.
Figure 4:
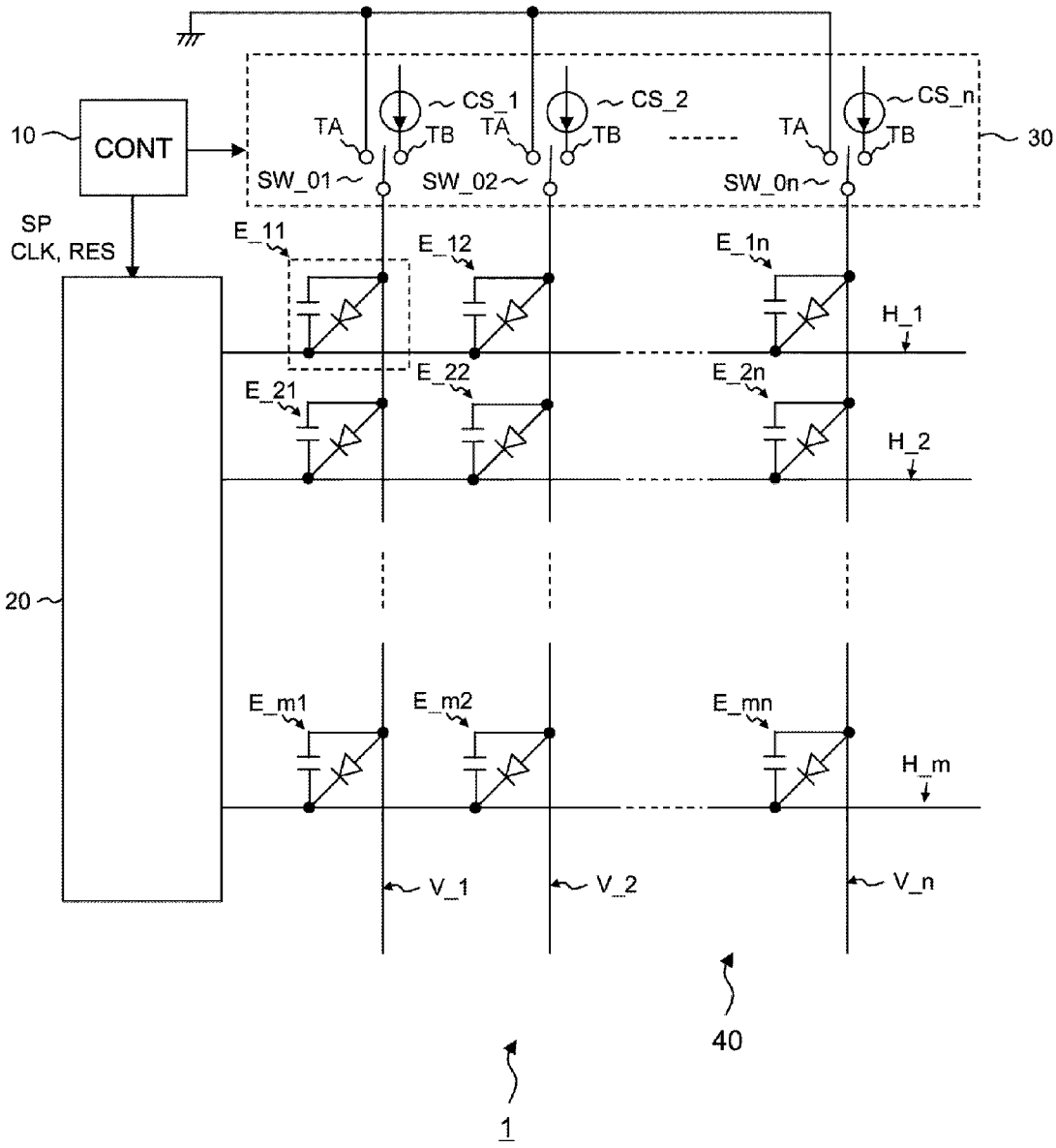
FIG. 4 is a diagram showing the configuration of a display unit to which a cathode driver in accordance with a first embodiment of the present invention is applied.

FIG. 4 is a diagram showing the configuration of a display unit to which a driver in accordance with an embodiment of the present invention is applied.

In a display panel 40 shown in FIG. 4, m×n number of OLED elements E_11 to E_mn that are arranged in a matrix are connected to intersections between m number of cathode lines (i.e., row lines) and n number of anode lines (i.e., column lines).

A cathode driver 20 for driving cathode lines (row lines) in the display panel 40 is a driver in accordance with an embodiment of the present invention.

The cathode driver 20 sequentially scans cathode lines H_1 to H_m based on a shift pulse SP and a clock CLK, both of which are output from a light-emitting control circuit (CONT) 10. Specifically, the cathode driver 20 connects a cathode line that is the target to be scanned to a ground potential (low-level or simply L-level), and connects other cathode lines that are not the targets to be scanned to a power supply potential $V_{DD}$ (high-level or simply H-level). Reverse bias voltage is applied to the OLED element that is connected to a cathode line connected to the H-level.

In addition, the cathode driver 20 performs reset control based on a reset signal RES (low active) that is output from the light-emitting control circuit 10. Potentials of all the cathode lines H_1 to H_m will be the L-level during the reset period during which the reset signal RES becomes the L-level, and electric charges built up in the parasitic capacitance components of the OLED elements will be discharged.

A specific circuit configuration of the cathode driver 20 will be hereinafter explained in detail.

A driver (anode driver 30) in the anode side of the OLED elements comprises n number of switching elements SW_01 to SW_0n that are connected to n number of anode lines V_1 to V_n, respectively. Each of the switching elements SW_01 to SW_0n includes a terminal TA and a terminal TB, and either of the terminals TA and TB is selected according to the control signal output from the light-emitting control circuit 10. The control signal reflects image data (not shown in the figure) that is provided to the light-emitting control circuit 10 from outside thereof. If the terminal TA is selected in the switching elements SW_01 to SE_0, the potentials of corresponding anode lines V_1 to V_n will be ground potential. On the other hand, if the terminal TB is selected in the switching elements SW_01 to SW_0n, the potentials of corresponding anode lines V_1 to V_n will be connected to corresponding constant current sources CS_1 to CS_n.

As with the cathode driver 20, the anode driver 30 performs reset control based on the reset signal RES that is output from the light-emitting control circuit 10. The terminal TA is selected in the switching elements SW_01 to SW_0n during the reset period during which the potential of the reset signal RES will be the L-level, and electric charges built up in the parasitic capacitance components of the OLED elements will be discharged.

Next, a specific configuration of the cathode driver 20 will be explained with reference to FIG. 5.

Figure 5:
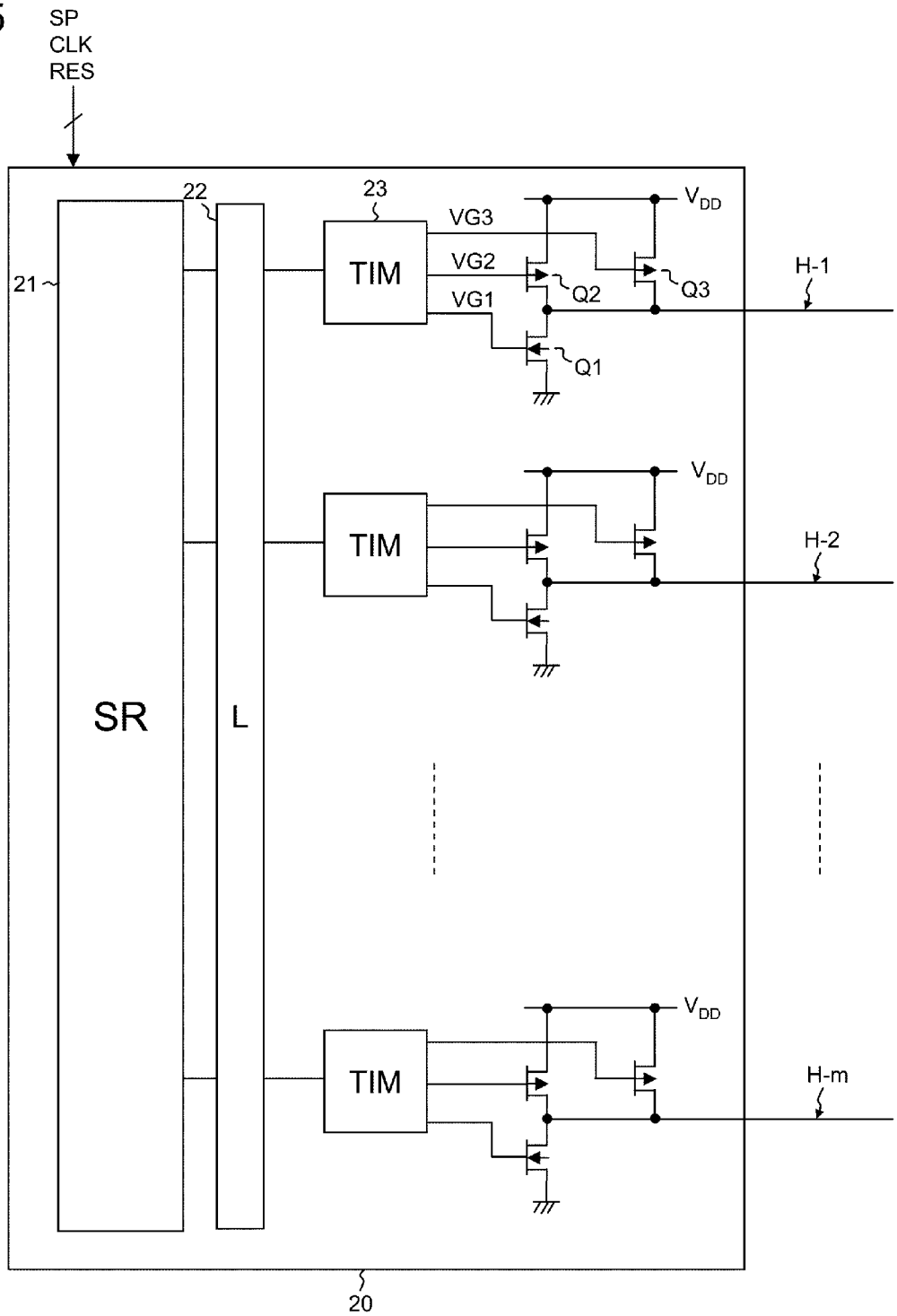
FIG. 5 is a block diagram showing the circuit configuration of the cathode driver in accordance with the first embodiment of the present invention.

FIG. 5 is a block diagram showing a circuit configuration of the cathode driver 20. As shown in FIG. 5, m number of configurations between the latch circuit (L) 22 and m number of cathode lines H_1 to H_m are the same in the cathode driver 20. Therefore, only the configuration between the latch circuit 22 and the cathode line H_1 will be hereinafter explained.

The cathode driver 20 comprises a shift register (SR) 21, the latch circuit 22, m number of timing circuits (TIMs) 23 that correspond to m number of transfer units in the shift register 21, respectively, and m number of groups of transistors Q1 to Q3 that are connected to the TIMs 23, respectively. Note that the transistors Q1 to Q3 correspond to the first to third transistors in the present invention, respectively.

The shift register 21 includes the m number of transfer units corresponding to the cathode lines H_1 to H_m, and operates by means of clock CLK that is output from the CONT 10. The shift register 21 sequentially transfers shift pulse SP that is output from the light-emitting control circuit 10 in the vertical direction.

The shift register 21 sets all the output to be the L-level when the reset signal RES output from the light-emitting control circuit 10 is inverted to the L-level.

The latch circuit 22 latches the output from the shift register 21 during the single scan period, and then outputs it to the subsequent timing circuit 23.

The output end of the timing circuit 23 is connected to a gate of the NMOS transistor Q1, a gate of the PMOS transistor Q2, and a gate of the PMOS transistor Q3. The timing circuit 23 receives the output signal and the reset signal RES from the latch circuit 22, and provides the gates of the transistors Q1 to Q3 with activation potentials VG1 to VG3, respectively, at a predetermined timing.

Note that the timing circuit 23 and the transistors Q1 to Q3 comprise a potential control unit in accordance with an embodiment of the present invention.

A drain of the NMOS transistor Q1 is connected to the cathode line H_1, and a source thereof is connected to the ground potential. The NMOS transistor Q1 will be switched on when the potential VG1 output from the timing circuit 23 is the H-level, and sets potential of the cathode line H_1 to be the ground level (L-level).

A drain of the PMOS transistor Q2 is connected to the cathode line H_1, and a source thereof is connected to the power supply potential $V_{DD}$. The PMOS transistor Q2 will be switched on when the potential VG2 is the L-level, and sets potential of the cathode line H_1 to be the power supply potential $V_{DD}$ (H-level). Here, the PMOS transistor Q2 has an on-resistance (first on-resistance) that is larger than that of the PMOS transistor Q3, so that the potential rising speed of the cathode line H_1 after the gate voltage is applied will be slow. Note that the on-resistance means the resistance of the current path between the source and the drain when the transistor is in the on-state.

A drain of the PMOS transistor Q3 is connected to the cathode line H_1, and a source thereof is connected to the power supply potential $V_{DD}$. The PMOS transistor Q3 will be switched on when the potential VG3 is the L-level, and sets the potential of the cathode line H_1 to be the power supply potential $V_{DD}$ (H-level). Here, the PMOS transistor Q3 has a small on-resistance (second on-resistance), so that the potential of the cathode line H_1 quickly reaches the power supply potential $V_{DD}$ after the gate voltage is applied.

Figure 6:
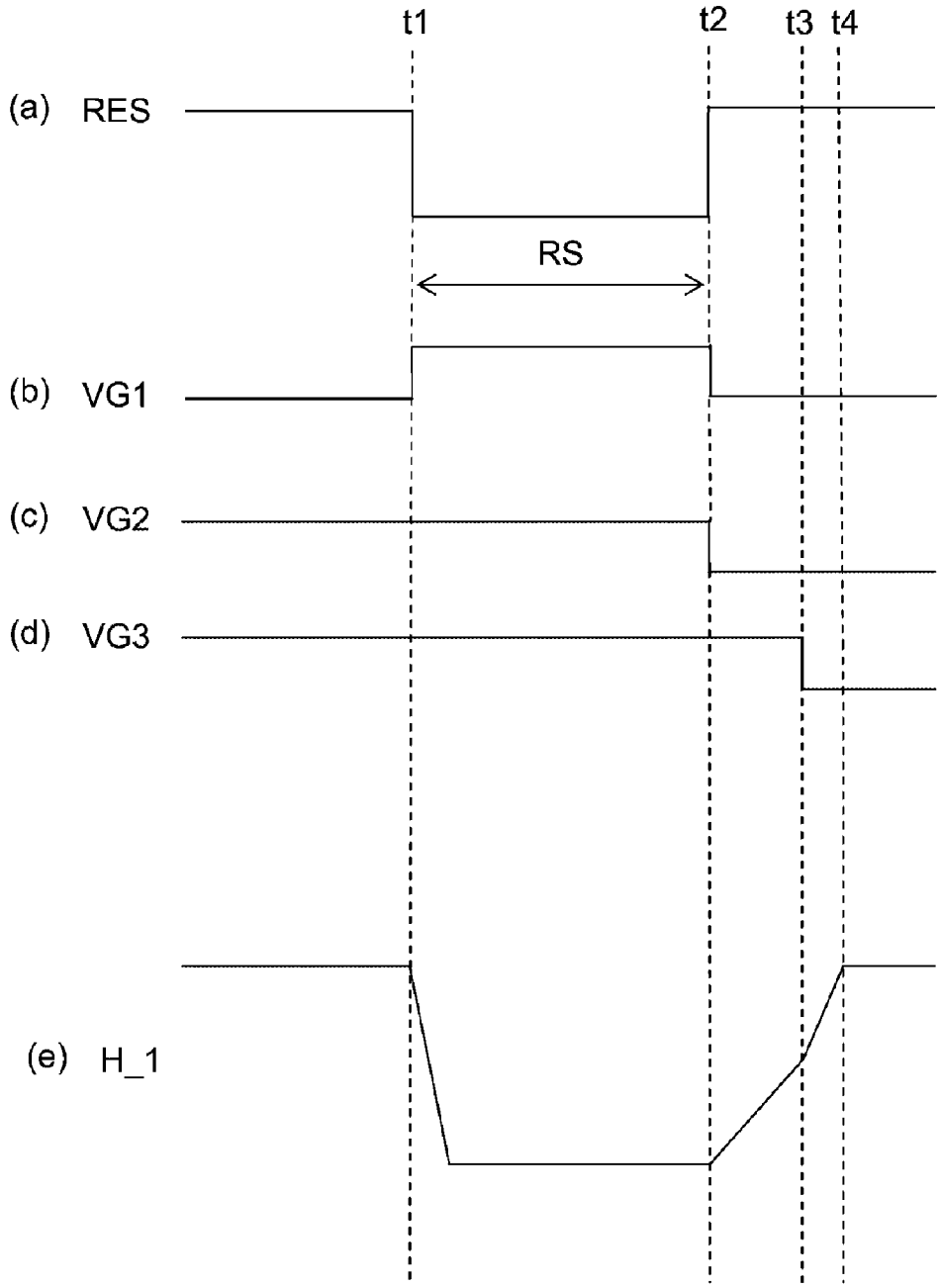
FIG. 6 is a timing chart for explaining the operation of the cathode driver in accordance with the first embodiment of the present invention.

Next, an operation of the cathode driver 20 during the reset period will be explained with reference to FIG. 6. FIG. 6 is a timing chart for explaining the operation of the cathode driver 20 during the reset period, and comprised of five sub-charts (a) to (e). The sub-charts (a), (b), (c), (d), and (e) indicate a reset signal RES, a potential VG1, a potential VG2, a potential VG3, and a potential of the cathode line H_1, respectively.

Note that FIG. 6 is a timing chart in a situation in which the cathode line H_1 is not the target to be scanned after the reset period RS elapses.

When the reset signal RES becomes the L-level (i.e., active) at a time t1, all of the outputs from the shift register 21 will be the L-level. Then, all of the outputs from the latch circuit 22 will be the L-level. As shown in FIG. 6, a period from the time t1 to a time t2 during which the reset signal RES becomes the L-level is the reset period RS.

The timing circuit 23 changes the potential VG1 from the L-level to the H-level at the start (time t1) of the reset period RS (see sub-chart (b) of FIG. 6). Because of this, the NMOS transistor Q1 is switched on, and the potential of the cathode line H_1 will be the L-level at the time t1 (see sub-chart (e) of FIG. 6).

When the reset signal RES becomes the H-level (i.e., non-active), in other words, when the reset period RS elapses, the timing circuit 23 changes the potential VG1 from the H-level to the L-level. Because of this, the NMOS transistor Q1 will be switched off.

Furthermore, the timing circuit 23 changes the potential VG2 from the H-level to the L-level at the time t2 (see sub-chart (c) of FIG. 6). Because of this, the PMOS transistor Q2 will be switched on, and the cathode line H_1 will be connected to the power supply potential $V_{DD}$. Here, the potential rising speed of the cathode line H_1 is slow because the on-resistance of the PMOS transistor Q2 is large. In other words, as shown in the sub-chart (e) of FIG. 6, the potential of the cathode line H_1 slowly rises from the time t2 to the time t3.

Next, the timing circuit 23 times a predetermined period (first period) from the time t2, and changes the potential VG3 from the H-level to the L-level at the time t3 when the first period elapses (see sub-chart (d) of FIG. 6). Because of this, the PMOS transistor Q3 will be switched on. Here, the potential rising speed of the cathode line H_1 is fast because the on-resistance of the PMOS transistor Q3 is smaller than that of the PMOS transistor Q2. In other words, as shown in sub-chart (e) of FIG. 6, the potential of the cathode line H_1 quickly reaches the power supply potential $V_{DD}$ from the time t3 to the time t4.

As described above, in the cathode driver 20 in accordance with the present embodiment, potentials of the cathode lines are controlled by the timing circuit 23 so that potentials of the cathode lines that are not the targets to be scanned slowly change (from the L-level to the H-level) immediately after the reset period RS elapses.

Note that the state of the NMOS transistor Q1 is changed from the on-state to the off-state at the time t2, and at the same time as this, the state of the PMOS transistor Q2 is changed from the off-state to the on-state at the time t2 in the timing chart shown in FIG. 6. However, it is preferable to shift the timing of switching off the NMOS transistor Q1 slightly earlier than the time t2 for the purpose of reliably preventing through current between the power supply potential $V_{DD}$ and the ground potential. In this case, the timing circuit 23 times a predetermined period (second period) that is shorter than the reset period from the time t1, and changes the potential VG1 from the H-level to the L-level after the second period elapses.

Figure 7:
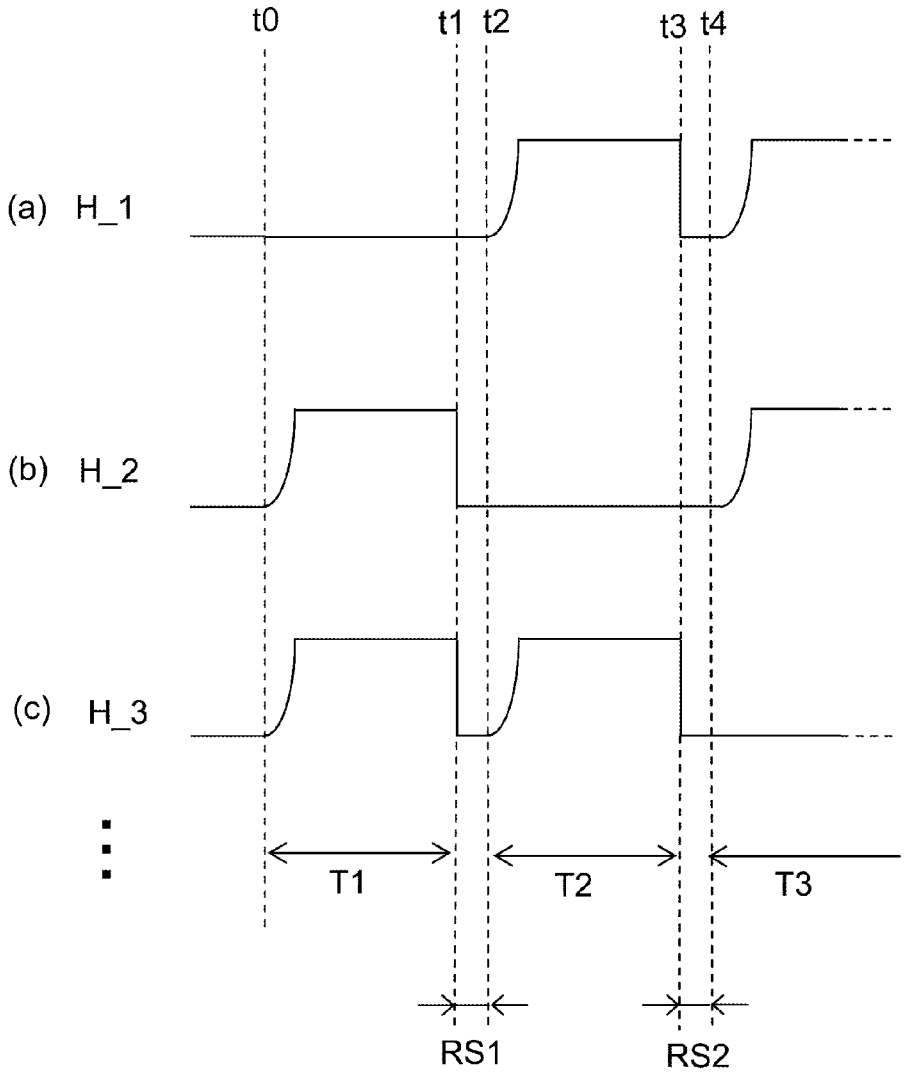
FIG. 7 is a timing chart for explaining the overall operation of the cathode driver in accordance with the first embodiment of the present invention.

Next, the overall operation of the cathode driver 20 will be explained with reference to FIG. 7. FIG. 7 is a timing chart for explaining the overall operation of the cathode driver 20, and comprised of three sub-charts (a) to (c). The sub-charts (a), (b), and (c) indicate a potential of the cathode line H_1, a potential of the cathode line H_2, and a potential of the cathode line H_3, respectively.

In FIG. 7, the shift register 21 starts scanning at a time t0. In other words, after the time t0, the shift register 21 sequentially transfers a shift pulses SP that is output from the light emitting control circuit 10 in the vertical direction.

In FIG. 7, the cathode line H_1 will be the target to be scanned and an output from the shift register 21 corresponding to the cathode line H_1 will be the H-level during the period T1 (i.e., period from the time t to the time t1).

In the cathode driver 20, the timing circuit 23 that is the target to be scanned controls the potentials VG1 to VG3, so that all of them become the H-level during the single scan period if the H-level shift pulse SP to be sequentially transferred is input into the timing circuit 23. Therefore, only the transistor Q1 will be switched on, and the potential of the cathode line H_1 will be the power supply potential (L-level) during the period T1 that is a single scan period for the cathode line H_1.

A period from the time t1 to the time t2 is the reset period RS1. During the reset period RS1, all of the outputs from the shift register 21 will be the L-level, and the potentials of all the cathode lines H_1, H_2, H_3, . . . will be the power supply potential (L-level).

When the reset period RS1 elapses at the time t2, the output of the shift register 21 corresponding to the cathode line H_2 that is the target to be scanned will be the H-level. In FIG. 7, the period T2 (i.e., period from the time t2 to the time t3) is a single scan period for the cathode line H_2. During the period T2, outputs from the latch circuit 22 corresponding to the cathode line H_2 will be fixed to the H-level. Because of this, potential of the cathode line H_2 will be the ground level (L-level) during the period T2 during which the cathode line H_2 is scanned, as with the case of the cathode line H_1 during the period T1.

On the other hand, outputs from the shift register 21 corresponding to the cathode lines H_1, H_3, . . . that are not the targets to be scanned will be the L-level after the reset period RS1 elapses at the time t2. Accordingly, as explained above with reference to FIG. 6, the potentials of the cathode lines H_1, H_3, . . . slowly rise from the ground potential (L-level) to the power supply potential $V_{DD}$ (H-level) by means of the operation of the timing circuit corresponding to the cathode lines H_1, H_3, . . . , as shown immediately after the time t2 in the sub-charts (a) and (b) of FIG. 7.

A period from the time t3 to the time t4 is a reset period RS2. During the reset period, all of the outputs from the shift register 21 will be the L-level, and the potentials of all the cathode lines H_1, H_2, and H_3, . . . will be the ground level (L-level).

An output from the shift register 21 corresponding to the cathode line H_3 that will be the next target to be scanned will be the H-level after the reset period RS2 elapses at the time t4. In FIG. 7, a period T3 (i.e., period after the time t4) is a single scan period for the cathode line H_3. During the period T3, the output from the latch circuit 22 corresponding to the cathode line H_3 will be fixed to the H-level. Because of this, the potential of the cathode line H_3 will be the ground level (L-level) during the period T3 during which the cathode line H_3 is being scanned, as with the case of the cathode line H_1 during the period T1.

On the other hand, outputs from the shift register 21 corresponding to the cathode lines H1, H2, . . . that are not the targets to be scanned during the period T3 will be the L-level after the reset period RS2 elapses at the time t4. Accordingly, as explained above with reference to FIG. 6, the potentials of the cathode lines H_1, H_2, . . . slowly rise from the ground potential (L-level) to the power supply potential $V_{DD}$ (H-level) by means of the operation of the timing circuit corresponding to the cathode lines H_1, H_2, . . . as shown immediately after the time t4 in the sub-charts (a) and (b) of FIG. 7.

In the same way, the cathode line H_4 and the subsequent cathode lines are sequentially scanned, and a reset period is set to be inserted between two adjacent scanning periods. At the same time as this, the potentials of the cathode lines that are not the targets to be scanned will slowly rise immediately after the reset period.

As described above, the cathode driver 20 in accordance with the present embodiment is provided with a plurality of groups composed of the timing circuit 23 and the transistors Q1 to Q3 that correspond to each of the cathode lines. In addition, the cathode driver 20 is set to control the timing at which the timing circuit 23 switches on the transistors Q1 to Q3, so that potentials of the cathode lines excluding the cathode line that is the target to be scanned (i.e., first line) are slowly changed from the ground potential (first reference potential) to the power supply potential $V_{DD}$ (second reference potential) after the reset period elapses.

Therefore, few high-frequency components are included in the voltage waveforms of the cathode lines excluding the cathode line that is the target to be scanned immediately after the reset period. In addition, the impedances of the parasitic capacitance components of the OLED elements connected to the cathode lines are maintained to be large. Accordingly, the parasitic capacitance components do not switch on. Therefore, the potentials of the anode lines that should not be originally high potential will not leap, and false emission and/or destruction of the OLED elements will not be caused. As a result, even if the OLED elements emit light with 5-bit (32 gradations) or greater, it is allowed to emit light with a high degree of accuracy. Moreover, it will be apparent to those skilled in the art from this disclosure that each OLED element may be comprised of three sub-elements respectively emitting RGB (i.e., red, green and blue) in order to realize a color display.

In addition, in FIG. 5, a NMOS transistor (Q1) has been conventionally necessary in order to connect the cathode line that is the target to be scanned to the ground potential. In addition, at least one PMOS transistor (Q3) has been conventionally necessary in order to connect a single or plurality of the cathode line(s) that is/are not the target(s) to be scanned to the power supply potential $V_{DD}$. However, the cathode driver 20 in accordance with the present embodiment is realized only by adding one PMOS transistor (Q2) and changing the configuration of the timing circuit used for performing the time division control of the PMOS transistor. Therefore, the additional circuit size is allowed to be small that is necessary for the conventional cathode driver to realize the cathode driver 20 in accordance with the present embodiment.

Note that the degree to which the potentials of the cathode lines, excluding the cathode line that is the target to be scanned, slowly change after the reset period elapses depends on the parasitic capacitance components of the OLED elements on the display panel 40 and drive performance of the transistors Q1 to Q3 included in the cathode driver 20. Therefore, it is not necessarily appropriate to suggest only one configuration, however, for example, the rate of potential change to time may be set for each of the display panels so that false emission and/or destruction of the OLED elements are not caused, and the dynamic characteristics of the transistors Q1 to Q3 may be set so that values of the potential changes of the cathode lines are the same as the values of the rates of potential changes to time thereof or less.

Second Embodiment

A driver in accordance with the second embodiment of the present invention will be explained with reference to FIGS. 8 and 9.

The cathode driver in accordance with the second embodiment of the present invention is the same as the cathode driver 20 in accordance with the first embodiment of the present invention in that potentials of all the cathode lines excluding the cathode line that is the target to be scanned are slowly changed from the ground potential (first reference potential) to the power supply potential $V_{DD}$ (second reference potential) after the reset period elapses. However, the circuit configuration of the cathode driver in accordance with the present embodiment that achieves this is different from that of the cathode driver 20 in accordance with the first embodiment.

The specific configuration of the cathode driver 28 in accordance with the second embodiment will be explained with reference to FIG. 8.

Figure 8:
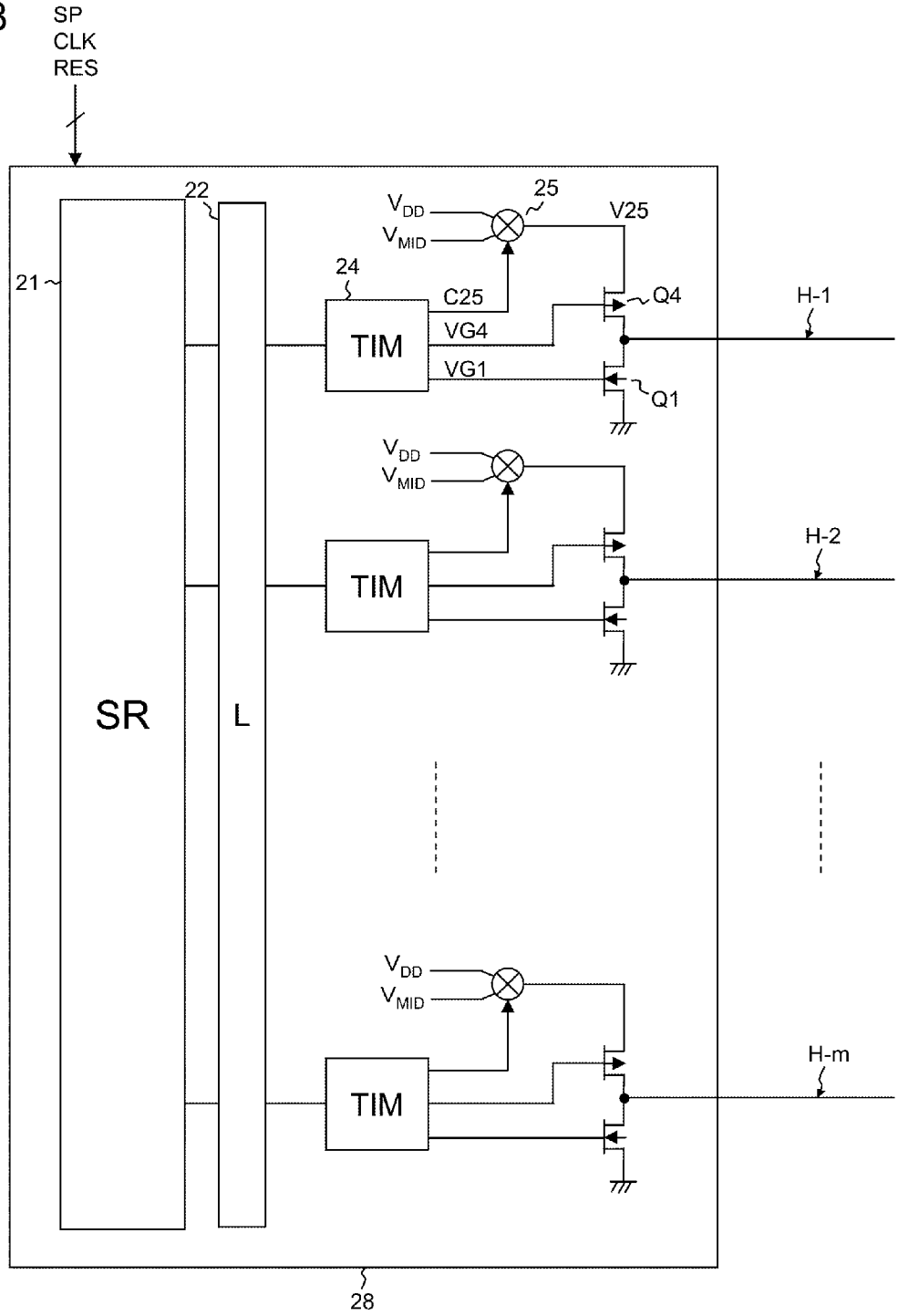
FIG. 8 is a block diagram showing the circuit configuration of a cathode driver in accordance with a second embodiment of the invention.

FIG. 8 is a block diagram showing a circuit configuration of the cathode driver 28. As shown in FIG. 8, configurations between the latch circuit 22 and the cathode lines H_1 to H_m in the cathode driver 28 are all the same as each other. Therefore, only the configuration between the latch circuit 22 and the cathode line H_1 will be hereinafter explained. Note that the same numerals are given to units/components shown in FIG. 8 that are the same as those shown in FIG. 5, and explanations thereof will be hereinafter omitted.

The cathode driver 28 comprises a shift register (SR) 21, a latch circuit (L) 22, timing circuits (TIMs) 24 that correspond to m number of transfer units in the sift register 21, respectively, m number of groups of transistors Q1 and Q4 that are connected to each of the timing circuits 24, and m number of selectors 25. Note that the transistor Q4 corresponds to a fourth transistor in accordance with the present invention.

The output end of the timing circuit 24 is connected to a gate of the NMOS transistor Q1 and a gate of the PMOS transistor Q4. The timing circuit 24 receives an output signal and a reset signal RES from the latch circuit 22, and provides the gates of the transistors Q1 and Q4 with activation potentials VG1 and VG4, respectively, at a predetermined timing. At the same time as this, it provides the selector 25 with a control signal C25 at a predetermined timing.

Each of the selectors 25 selects and outputs either the power supply potential $V_{DD}$ or an intermediate potential $V_{MID}$ in response to the control signal C25 from the corresponding timing circuit 24. The intermediate potential $V_{MID}$ is a predetermined potential within the range from the ground potential to the power supply potential $V_{DD}$. Specifically, the intermediate potential $V_{MID}$ is selected when the control signal C25 is the L-level, and the power supply potential $V_{DD}$ is selected when the control signal C25 is the H-level. "V25" shown in FIG. 8 indicates a potential of the output terminal of the selector 25, and will be either the intermediate potential $V_{MID}$ or the power supply potential $V_{DD}$.

Note that the timing circuit 24, the selector 25, and the transistors Q1 and Q4 comprises a potential control unit in accordance with an embodiment of the present invention.

A drain of the NMOS transistor Q1 is coupled to the cathode line H_1, and a source thereof is connected to the ground potential. The NMOS transistor Q1 will be switched on when the potential VG1 output from the timing circuit 23 is the H-level, and sets potential of the cathode line H_1 to be the ground potential (L-level).

A drain of the PMOS transistor Q4 is connected to the cathode line H_1, and a source thereof is connected to the output terminal of the selector 25. The PMOS transistor Q4 will be switched on when the potential VG2 is the L-level, and connects the cathode line H_1 to the output terminal of the selector 25.

Next, an operation of the cathode driver 28 during the reset period will be explained with reference to FIG. 9. FIG. 9 is a timing chart for explaining the operation of the cathode driver 28 during the reset period, and comprised of six sub-charts (a) to (f). The sub-charts (a), (b), (c), (d), (e) and (f) indicate a reset signal RES, a potential VG1, a potential VG4, a control signal C25, an output potential V25 of the selector 25, and a potential of the cathode line H_1, respectively.

Figure 9:
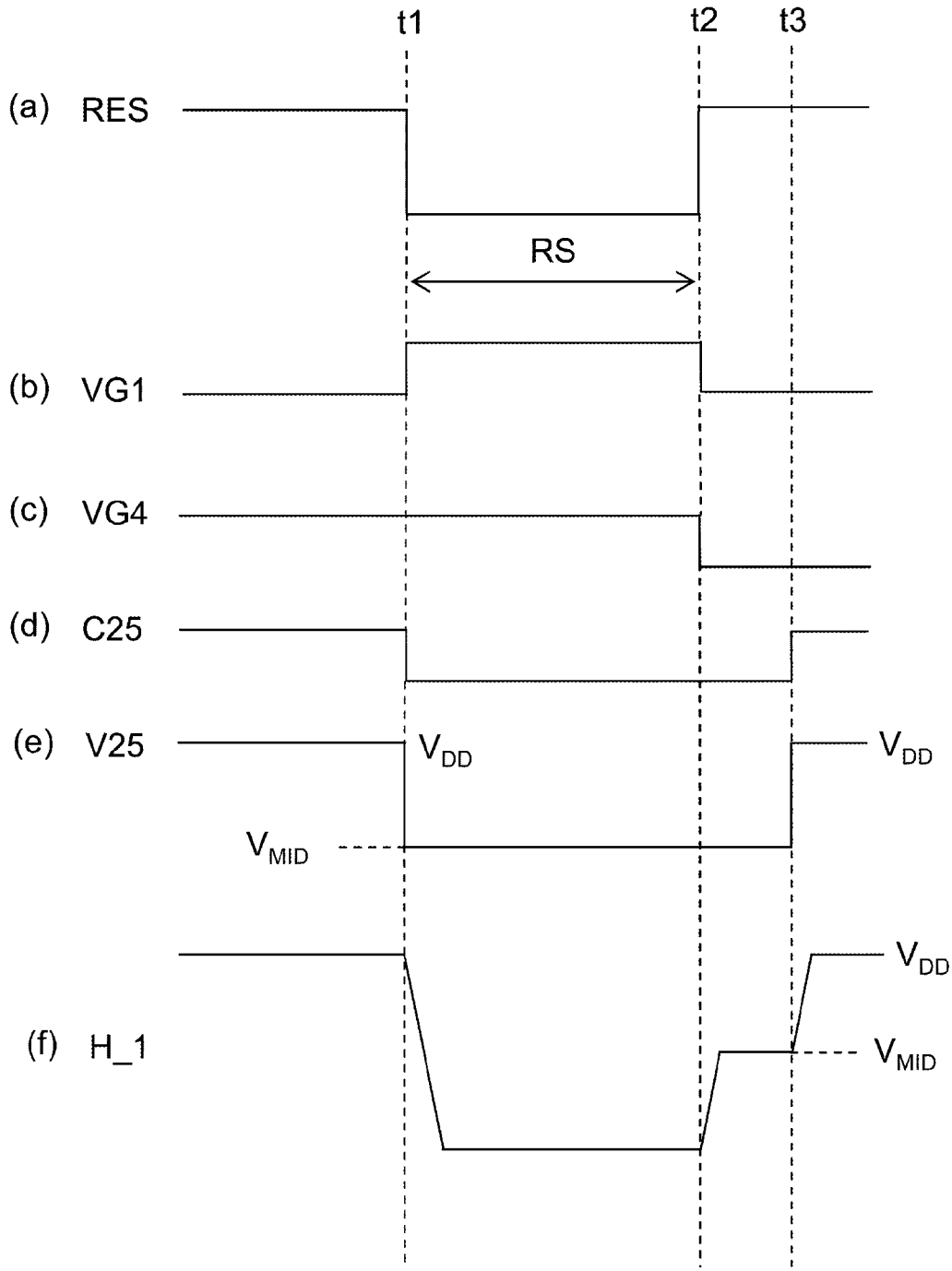
FIG. 9 is a timing chart for explaining the operation of the cathode driver in accordance with the second embodiment of the present invention.

Note that FIG. 9 is a timing chart in a situation in which the cathode line H_1 is not the target to be scanned after the reset period RS elapses.

When the reset signal RES becomes the L-level (i.e., active) at the time t1, all of the outputs from the shift register 21 will be the L-level. Then, all of the outputs from the latch circuit 22 will be the L-level. As shown in FIG. 9, a period from the time t1 to a time t2 during which the reset signal RES becomes the L-level is the reset period RS.

The timing circuit 24 changes the potential VG1 from the L-level to the H-level at the start (time t1) of the reset period RS (see sub-chart (b) of FIG. 9). Because of this, the NMOS transistor Q1 is switched on, and the potential of the cathode line H_1 will the L-level at the time t1 (see sub-chart (f) of FIG. 9).

In addition, the control signal C25 changes to the L-level at the time t1, and in response to this, the output potential V25 from the selector 25 changes from the power supply potential $V_{DD}$ to the intermediate potential $V_{MID}$ (see sub-charts (d) and (e) of FIG. 9).

When the reset signal RES becomes the H-level (i.e., non-active) at the time t2, in other words, when the reset period RS elapses, the timing circuit 24 changes the potential VG1 from the H-level to the L-level. Because of this, the NMOS transistor Q1 will be switched off.

Furthermore, the timing circuit 24 changes the potential VG4 from the H-level to the L-level at the time t2 (see sub-chart (c) of FIG. 9). Because of this, the PMOS transistor Q4 will be switched on, and the cathode line H_1 will be connected to the intermediate potential $V_{MID}$.

Next, the timing circuit 24 times a predetermined period (third period) from the time t2, and changes the control signal C25 from the L-level to the H-level at the time t3 when the third period elapses (see sub-chart (d) of FIG. 9). Because of this, the output potential V25 of the selector 25 will change from the intermediate potential $V_{MID}$ to the power supply potential $V_{DD}$ (see sub-chart (e) of FIG. 9), and in response to this, potential of the cathode line H_1 also will change from the intermediate potential $V_{MID}$ to the power supply potential $V_{DD}$ (see sub-chart (f) of FIG. 9).

As described above, in the cathode driver 28 in accordance with the present embodiment, the potential of the cathode lines is controlled by the timing circuit 24, so that potentials of the cathode lines that are not the targets to be scanned change (from the L-level to the H-level) in stages immediately after the reset period RS elapses.

Note that the state of the NMOS transistor Q1 is changed from the on-state to the off-state at the time t2, and at the same time as this, the state of the PMOS transistor Q4 is changed from the off-state to the on-state at the time t2 in the timing chart shown in FIG. 9. However, it is preferable to set the timing of switching off the NMOS transistor Q1 slightly earlier than the time t2 for the purpose of reliably preventing through current between the power supply potential $V_{DD}$ and the ground potential. In this case, the timing circuit 24 times a predetermined period (fourth period) that is shorter than the reset period from the time t1, and changes the potential VG1 from the H-level to the L-level after the fourth period elapses.

As described above, the cathode driver 28 in accordance with the present embodiment is provided with a plurality of groups composed of the timing circuit 24 and the transistors Q1 and Q4 that correspond to each of the cathode lines. In addition, the cathode driver 28 is set to control the timing at which the timing circuit 24 switches on the transistors Q1 and Q4, and the timing of switching the selector 25, so that potentials of the cathode lines excluding the cathode line that is the target to be scanned (first line) is changed from the ground potential (first reference potential) to the power supply potential $V_{DD}$ (second reference potential) in stages after the reset period elapses.

Therefore, the potentials of the cathode lines, excluding the cathode line that is the target to be scanned, slowly rise immediately after the reset period. Accordingly, the cathode driver 28 in accordance with the present embodiment also has the same effect as that of the cathode driver 20 in accordance with the first embodiment.

The preferred embodiments of the present invention have been herein described in detail. Specific configuration and system thereof are not limited to the present embodiments. The present invention includes changes and modifications of the design thereof and applications to other systems within the scope of the content of the present invention.

For example, in the second embodiment of the present invention, an example in which the selector 25 is allowed to set two potentials (i.e., the power supply potential $V_{DD}$ and the intermediate potential $V_{MID}$) is provided. However, the number of the selectable potentials by the selector 25 is not limited to two. If the number of selectable potentials by the selector 25 is set to be three or greater, it will be possible to further smooth the rising edge of the potential after the reset period elapses. In addition, it will be possible to more reliably prevent the parasitic capacitance components of the OLED elements from switching on.

In addition, in the example of the circuit configuration shown in FIGS. 5 and 8, a plurality of timing circuits corresponding to cathode lines, respectively, are provided. However, the functions of the timing circuits are all the same. Therefore, it is possible to configure the circuit with one mutual timing circuit.

GENERAL INTERPRETATION OF TERMS

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applied to words having similar meanings such as the terms, "including," "having," and their derivatives. Also, the term "part," "section," "portion," "member," or "element" when used in the singular can have the dual meaning of a single part or a plurality of parts. Finally, terms of degree such as "substantially," "about," and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents. Thus, the scope of the invention is not limited to the disclosed embodiments.

What is claimed is:

1. A driver for a display panel in which a plurality of light-emitting elements are arranged in a matrix at intersections between a plurality of row lines and a plurality of column lines, comprising:

a scan unit configured to sequentially scan the plurality of row lines during a scan period by connecting a first row line to be scanned to a first reference potential, and by connecting all the other row lines excluding the first row line to a second reference potential, the second reference potential being higher than the first reference potential;

a reset unit configured to connect the plurality of row lines to the first reference potential during a reset period between two scan periods for adjacent row lines;

a potential control unit configured to control potentials of the other row lines excluding the first row line from the first reference potential to the second reference potential at a predetermined ratio of potential change to time or less after the reset period elapses;

a plurality of timing circuits configured to start timing a first period at the end of the reset period, each of the plurality of timing circuits being provided to correspond to each of the plurality of row lines;

a plurality of first transistors, each of which is connected between each of the plurality of row lines and the first reference potential, each of the plurality of first transistors being switched on during the reset period;

a plurality of second transistors, each of which includes a first on-resistance, each of the plurality of second transistors being connected between each of the plurality of row lines and the second reference potential, and each of the plurality of second transistors being switched on at the end of the reset period; and a plurality of third transistors, each of which has a second on-resistance, the second on-resistance being smaller than the first on-resistance, each of the plurality of third transistors being connected between each of the plurality of row lines and the second reference potential, and each of the plurality of third transistors being switched on after the first period elapses.

2. The driver for a display panel according to claim 1, wherein each of the plurality of timing circuits times a second period, the second period being shorter than the reset period from the start of the reset period; and each of the plurality of first transistors is switched off after the second period elapses.

3. The driver for a display panel according to claim 1, wherein the plurality of light-emitting elements are controlled to emit light with 32 gradations or greater.

4. The driver for a display panel according to claim 1, wherein each of the plurality of light-emitting elements comprises three sub-elements, the three sub-elements respectively emitting red, green, and blue light, each of the sub-elements being controlled to emit light with 32 gradations or greater.

* * * * *